US007350277B1

(12) United States Patent
Canfield et al.

(10) Patent No.: US 7,350,277 B1
(45) Date of Patent: Apr. 1, 2008

(54) BUCKLE FOR SAFETY EQUIPMENT

(75) Inventors: DeForest Canfield, Oxford, NY (US); Robert Whitehead, Montrosz, PA (US); James Rullo, Binghamton, NY (US)

(73) Assignee: Buckingham Manufacturing Company, Inc., Binghamton, NY (US)

( * ) Notice: Subject to any disclaimer, the term of this patent is extended or adjusted under 35 U.S.C. 154(b) by 242 days.

(21) Appl. No.: 11/152,451

(22) Filed: Jun. 14, 2005

(51) Int. Cl.
*A44B 11/25* (2006.01)

(52) U.S. Cl. ..... 24/634; 24/637

(58) Field of Classification Search ..... None
See application file for complete search history.

(56) References Cited

U.S. PATENT DOCUMENTS

| | | | | | |
|---|---|---|---|---|---|
| 1,209,369 | A | * | 12/1916 | Wood | 24/648 |
| 1,459,673 | A | | 6/1923 | Jabner | |
| 2,153,077 | A | * | 4/1939 | Clarke | 24/645 |
| 3,201,840 | A | * | 8/1965 | Jantzen | 24/634 |
| 3,605,210 | A | * | 9/1971 | Lohr | 24/635 |
| 3,713,192 | A | | 1/1973 | Wallin | |
| 3,789,467 | A | * | 2/1974 | Aratani et al. | 24/648 |
| 5,355,562 | A | * | 10/1994 | Matoba et al. | 24/625 |
| 5,561,891 | A | | 10/1996 | Hsieh | |
| 5,584,106 | A | | 12/1996 | Anscher | |
| 5,729,877 | A | | 3/1998 | Kong et al. | |
| 6,163,942 | A | | 12/2000 | Liao | |
| 6,668,434 | B2 | * | 12/2003 | Casebolt et al. | 24/634 |
| 2003/0074772 | A1 | | 4/2003 | Chen | |

* cited by examiner

*Primary Examiner*—Jack W. Lavinder
(74) *Attorney, Agent, or Firm*—Mark Levy & Associates, PLLC

(57) ABSTRACT

A buckle that is resistant to unintentional or accidental release for joining the distal ends of a web, having a first portion with a rigid, bifurcated tongue. A pair of outward-facing protrusions located on the edges of the tongue at its distal end are adapted for engagement with a locking mechanism disposed within a mating buckle component. The mating buckle component has a rigid block or key centrally located so that as the bifurcated tongue is inserted into the receiving buckle component, the central opening of the bifurcated tongue surrounds and fits snuggly against the rigid central block or key. Side-to-side movement of the tongue (i.e., cocking) is thereby prevented. This lack of side-to-side movement, in cooperation with the latching mechanism, helps prevent accidental unlocking of the buckle.

17 Claims, 3 Drawing Sheets

BUCKLE FOR SAFETY EQUIPMENT

FIELD OF THE INVENTION

The present invention relates to buckles and, more particularly to buckles for a climber's, linesman's or arborist's belts, harness or saddles wherein the buckle resists accidental opening.

BACKGROUND OF THE INVENTION

Buckles for climber's, linesman's or arborist's belts, harness or saddles and other applications are well known in the art. These types of equipment are typically worn by workers when working at significant heights or in other situations where a fall could be injurious or even fatal. To be practical, a buckle for such equipment must present a combination of ease of fastening and resistance to accidental opening. Buckles of the prior art can be improved to provide adequate protection against accidental opening.

Buckles designed for applications such as climber's, linesman's or arborist's belts, harnesses or saddles and other such applications typically require activation of release mechanisms disposed on opposite sides of the buckle for the buckle to open. Under normal circumstances, this approach to preventing accidental buckle opening is adequate. However, in some applications, for example when an arborist is engaged in trimming a tree, a foreign object may accidentally activate the release mechanism on one side of the buckles of the prior art. In this case, accidental activation of the release mechanism on the opposite side of the buckle may have catastrophic consequences. In some cases, this condition is exacerbated when one portion of a buckle assembly becomes cocked (i.e., experiences side-to-side motion) within the mating buckle portion. This may happen when a foreign object, for example a tree branch, presses against the buckle as a wearer pursues his or her activity while wearing a belt, harness, saddle, fall arrester, or the like.

What is required, therefore, is a device that minimizes or prevents accidental opening of the buckle, particularly when the buckle is subjected to stresses which could cock one buckle component with respect to another buckle component.

DISCUSSION OF THE RELATED ART

Many attempts to provide accidental release prevention may be found in buckles of the prior art. For example, U.S. Pat. No. 1,459,673 for CLASP, issued Sep. 26, 1922 to Louis Jabner, shows a clasp having dual release mechanisms.

U.S. Pat. No. 3,713,192 for BUCKLES FOR SAFETY BELTS, issued Jan. 30, 1973 to Jan-Olof Raymond Wallin, teaches a seat belt buckle having a notched, bifurcated tongue. The bifurcated tongue is held by two locking hooks that engage protrusions on the outer edges of the bifurcated tongue.

U.S. Pat. No. 5,561,891 for FASTENER STRUCTURE BETWEEN A DIVING FLIPPER AND A TIGHTENING STRAP THEREOF, issued Oct. 8, 1996 to Hsing-Chi Hsieh, shows another clasping mechanism having a tongue and dual release mechanisms located on opposite sides of a housing receiving the tongue.

U.S. Pat. No. 5,584,106 for HELMET STRAP BUCKLE ASSEMBLY, issued Dec. 17, 1996 to Joseph Anscher, teaches a buckle with a resilient tongue having protrusions on outside edges of its distal end. The protrusions are captured in mating openings. The buckle is released by pressing both protrusions inwardly, thereby distorting the tongue and releasing the protrusions from the openings.

U.S. Pat. No. 5,729,877 for PINCH RESISTANT BUCKLE ASSEMBLY, issued Mar. 24, 1998 to C. Kwai Kong, teaches a mechanism similar to that of ANSCHER. However, KONG teaches a protective structure over the openings to help prevent accidental release of the buckle.

U.S. Pat. No. 6,163,942 for TWO-PIECE LOCK WITH HIDDEN LOCKING MECHANISM, issued Dec. 26, 2000 to Chien-Chen Liao, also teaches a structure similar to that of ANSCHER. However, LIAO adds an auxiliary mechanism that must be activated before the protruding portions of the tongue may be depressed and withdrawn from the receiving portion of the buckle.

Published United States Patent Application No. 2003/0074772 for MOVABLE BUCKLE STRUCTURE, published Apr. 24, 2003 upon application by Ang-yo Chen, shows a buckle assembly having a tongue with two pivoting latching blocks adapted for engaging openings in a receiving housing. The tongue also has a guiding block which is received in a guiding track in the receiving portion of the buckle assembly.

None of the patents or the published patent application, singly or in any combination, anticipates or suggests the novel buckle of the present invention.

SUMMARY OF THE INVENTION

In accordance with the present invention, there is provided a buckle that is resistant to unintentional or accidental release. A first portion of the novel buckle assembly has a rigid, bifurcated tongue. A pair of outward-facing protrusions located on the edges of the tongue at its distal end is adapted for engagement with a locking mechanism disposed within a mating buckle component. The mating buckle component has a rigid block forming a keying component centrally located so that as the bifurcated tongue is inserted into the receiving buckle component, the central opening of the bifurcated tongue surrounds and fits snuggly against the keying component. Side-to-side movement of the tongue (i.e., cocking) is thereby prevented. This lack of side-to-side movement, in cooperation with the latching mechanism, helps prevent accidental unlocking of the buckle.

It is, therefore, an object of the invention to provide a buckle that is difficult or impossible to unintentionally or accidentally unlatch.

It is another object of the invention to provide a buckle that requires rotation (i.e., depression) of two diametrically opposed release mechanisms to release a tongue portion of the buckle.

It is a further object of the invention to provide a buckle wherein two diametrically opposed release mechanisms are recessed to minimize contact with environmental objects in their vicinity.

It is an additional object of the invention to provide a buckle wherein rotation (i.e., depression) of any one of the two diametrically opposed release mechanisms will not release the tongue portion of the buckle.

It is a still further object of the invention to provide a buckle wherein cocking of the tongue within the receiving portion of the buckle is minimized.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

The buckle of the present invention represents an improvement in safety compared to buckles of the prior art. It is critical that when a worker is wearing safety equipment, for example, a work-positioning belt, a safety harness, an arborist's belt, an arborist's saddle, a fall arrester, and the like, the buckle thereof remain mated because the worker's life may depend upon the reliability of the buckle. In many occupations requiring such safety equipment, for example, when topping a tree, the buckle may be pressed against, brushed, or impacted by, or otherwise influenced by an environmental object such as a protruding branch. Under such circumstances, it is essential that the buckle remain closed.

Figure 1:
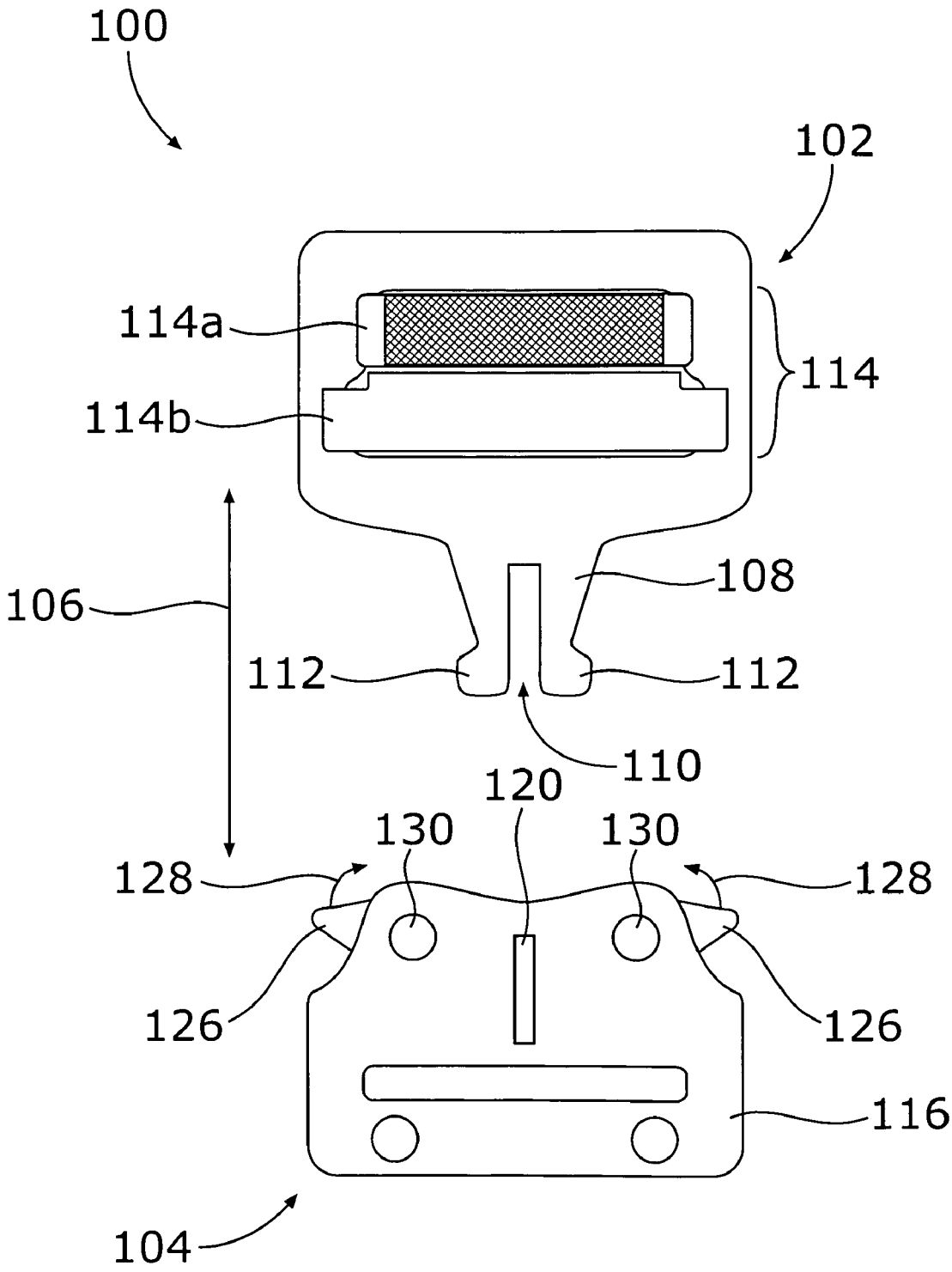
FIG. 1 is top, plan view of two portions of the buckle of the invention in an unmated configuration.
Figure 2:
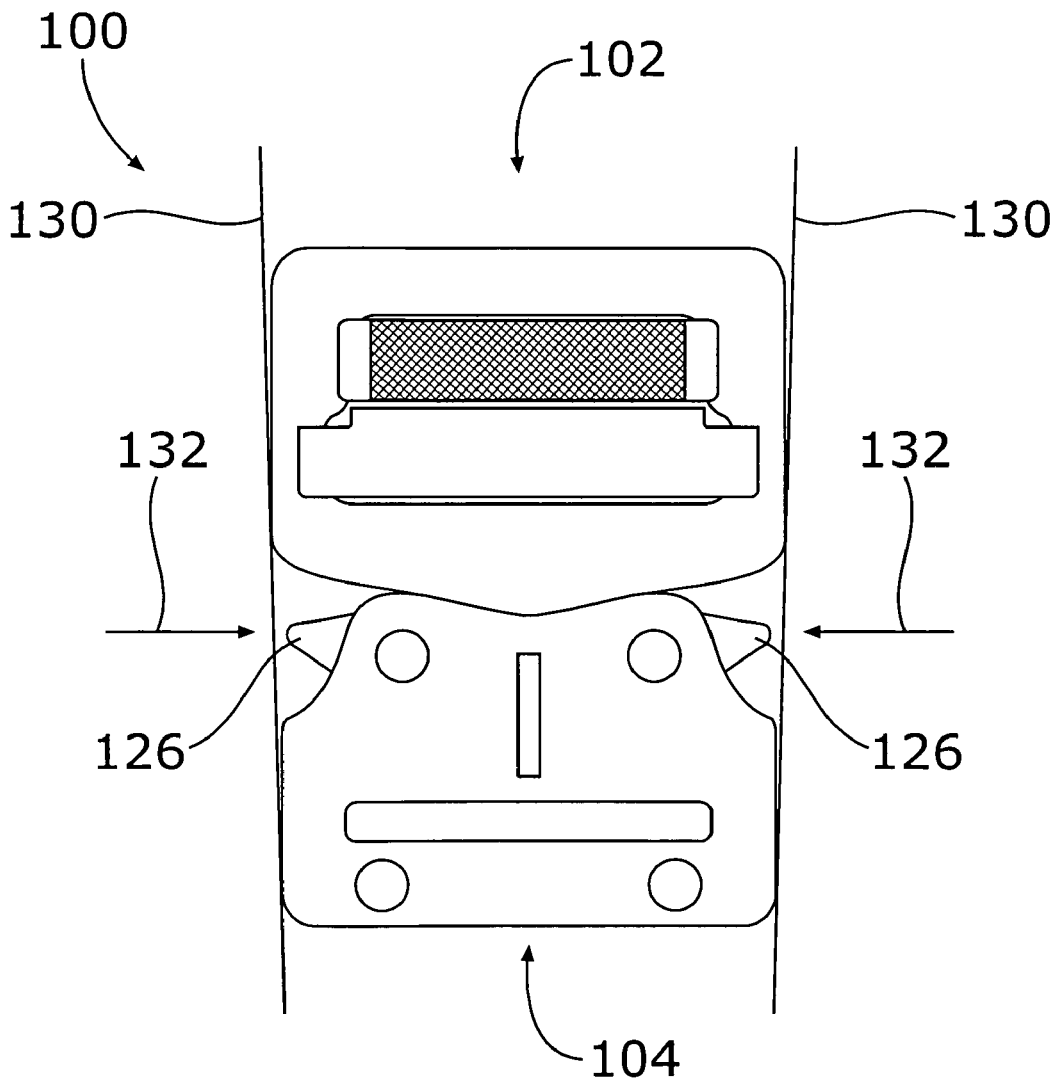
FIG. 2 is a top, plan view of the buckle of FIG. 1 in a mated configuration.
Figure 3:
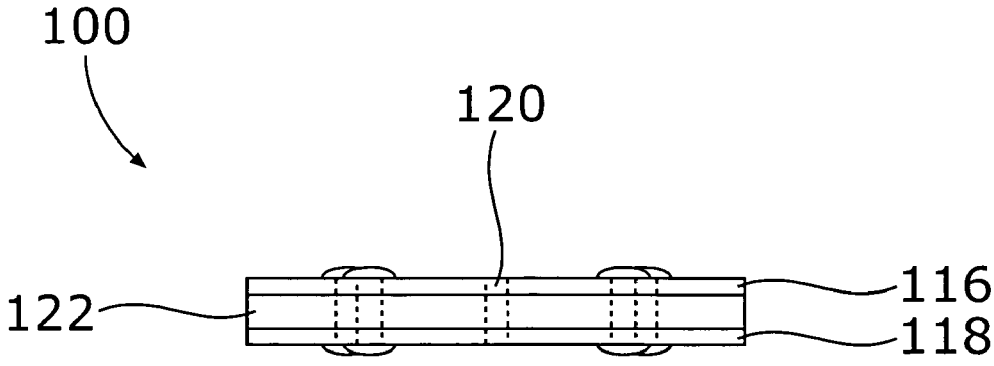
FIG. 3 is an end, elevational view of the receiver portion of the buckle of FIGS. 1 and 2.
Figure 4:
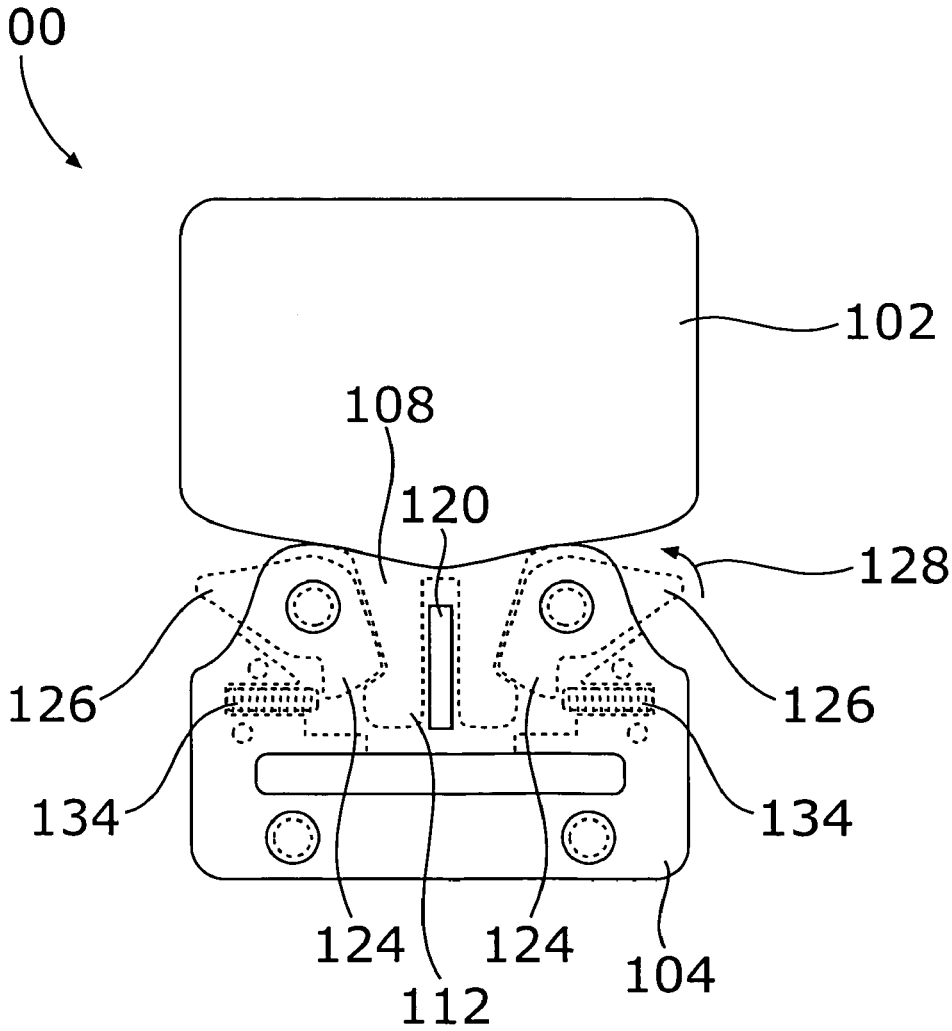
FIG. 4 is a top, plan, cut-away view of the buckle of FIG. 2 schematically showing the internal interaction of the buckle components.

Referring now to FIGS. 1-4, there are shown top, plan views (unmated and mated), an end, elevational view, and cut-away, top, plan views, respectively of the buckle of the present invention, generally at reference number 100. FIG. 1 presents buckle 100 in its unmated (i.e., open) configuration. FIGS. 2 and 4 present buckle 100 in a mated (i.e., closed) configuration.

Buckle 100 has two portions: a tongue portion 102, and a receiver portion 104. In FIG. 1, tongue portion 102 and receiver portion 104 are shown separated from one another. Tongue portion 102 is adapted to slide into receiver portion 104 in a direction indicated by arrow 106. Tongue portion 102 has a protruding, bifurcated tongue 108 having a slot 110 centrally and longitudinally disposed therein. Slot 110 has a width no greater than the width of any portion of the legs on both sides thereof. Two outward-facing protrusions 112 are disposed, one on each edge of tongue 108 at the distal end thereof. Tongue 108 is solid and rigid. Typically, tongue portion 102, including tongue 108, is formed from a solid piece of steel or other suitable material. The steel may be a heat-treated, alloy steel. The rigidity of tongue 108 is important to the functioning of buckle assembly 100 as discussed in detail hereinbelow.

A belt or web length-adjusting mechanism 114 is disposed in tongue portion 102. In the embodiment chosen for purposes of disclosure, length adjusting mechanism 114 has a knurled bar or roller 114*a* and a keeper bar 114*b* held in tension against roller 114*a* by a spring, not shown, or another tensioning mechanism. Such mechanisms for gripping a web length passed between roller 114*a* and keeper 114*b* are well known to those of skill in the art. It will be recognized that other mechanisms for performing the length-adjusting function are known. The invention is not considered limited to the specific length-adjusting mechanism chosen for purposes of disclosure. Rather, the invention covers any mechanism suitable for performing the length-adjusting, web-gripping function.

Receiver portion 104 is a laminated structure having an upper plate 116 and a lower plate 118 (best seen in FIG. 3). A spacer portion 122 fills at least the perimeter of receiver portion 104.

Sandwiched between upper and lower plates 116, 118, respectively, is a solid, rigid key or bar 120 sized and configured to fit into slot 110 as tongue portion 102 is slid into receiver portion 104 when mating the buckle 100 portions 102, 104. Key or bar 120 and slot 110 are sized so that slot 110 easily slides around key or bar 120 during buckle mating, but tightly enough so that there is little or no side-to-side movement of tongue 108 once tongue 108 is inserted and locked in receiver portion 104.

A pair of pawls 124 is disposed between upper and lower plates 116, 118, each having a structure adapted to retain protrusions 112 of tongue 108 when buckle 100 is mated. External actuators 126 pivot about posts 130 in the direction indicated by arrows 128. Springs 134 bias pawls 124 against protrusions 112 thereby keeping the buckle in a latched, mated position. The rotation (i.e., depression) of both external actuators 126 overcome the bias provided by springs 134 and allow the removal of tongue 108 from receiving portion 104. It is, of course, necessary to release both pawls 124 from respective protrusions 112 to release tongue 108 from receiving portion 104, the interaction of slot 110 with guide block or key 120 helping prevent the withdrawal of tongue 108 from receiving portion 104 when only one of external actuators 126 are moved.

As may be readily seen in FIG. 2, external actuators 126 are protected from accidental exposure to an environmental object sliding along the sides of the buckle 100. Lines 130 show the location of external actuators 126 relative to the sides of buckle 100. Because releasing tongue 108 from pawls 124 requires rotation (depression) of external actuators 126, a brushing motion along a side of buckle 100 could possibly impart such motion. The inventive buckle 100, however, is protected from such actuation. Direct, inward pressure from a direction shown by arrows 132 would not generally rotate external actuators 126, so the release of the buckle 100 is not likely. Most importantly, pressure in a direction shown by arrows 132 cannot cock tongue 108 in receiver portion 102 because of the interaction of guide block or key 120 with slot 110 of tongue 108. Consequently, the position of protrusions 112 of tongue 108 relative to pawls 124 remains constant, even when the buckle 100 is subjected to an external influence.

FIG. 4 shows a schematic, cut-away view of tongue portion 102 seated in receiver portion 104. The interaction of protrusions 112 of tongue 108 with pawls 124 may be clearly seen. In addition, the relative positions of slot 110 in tongue 108 are also clearly shown.

Since other modifications and changes varied to fit particular operating requirements and environments will be apparent to those skilled in the art, the invention is not considered limited to the examples chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A buckle for joining two distal ends of a web attached thereto, comprising:

a) a thin, flat insertion portion comprising a rigid, bifurcated tongue having two longitudinal legs with varying width dimension and a predetermined outer contour and projecting longitudinally away from a body region thereof and defining a longitudinal axis, said tongue comprising a central, open slot extending from a distal end thereof inwardly along said longitudinal axis toward said body region, said open slot having a width no greater than the width of any portion of said longitudinal legs;

b) a receiver portion for slidably receiving and retaining said tongue therein, said receiver portion comprising an internal guide block key adapted and configured to interact with said open slot in a manner so as to minimize side-to-side movement of said tongue when retained in said receiver portion; and c) a pawl for releasably locking said tongue within said receiver portion, said pawl having an outer contour that is a mirror shape to said outer contour of said longitudinal legs for complete engagement thereof.

2. The buckle for joining two distal ends of a web attached thereto as recited in claim 1, wherein said tongue comprises an outward-facing protrusion disposed on each edge thereof proximate said distal end and said pawl is adapted for releasable interaction with one of said protrusions.

3. The buckle for joining two distal ends of a web attached thereto as recited in claim 2, wherein said pawl for releasably locking said tongue comprises two pawls, each adapted for releasable interaction with respective ones of said protrusions.

4. The buckle for joining two distal ends of a web attached thereto as recited in claim 3, further comprising a biasing mechanism for holding said pawl in releasable contact with a respective one of said protrusions.

5. The buckle for joining two distal ends of a web attached thereto as recited in claim 4, wherein said biasing mechanism comprises a spring.

6. The buckle for joining two distal ends of a web attached thereto as recited in claim 3, wherein each of said two pawls comprises an outer portion projecting beyond a housing of said second, receiver portion so as to be accessible.

7. The buckle for joining two distal ends of a web attached thereto as recited in claim 6, wherein rotation (depression) of each of said outer portion of each of said two pawls is required to release said external protrusions of said tongue from respective ones of said pawls thereby releasing said tongue from said receiving portion.

8. The buckle for joining two distal ends of a web attached thereto as recited in claim 2, further comprising:

d) means for attaching at least one of said insertion portion and said receiver portion to a web.

9. The buckle for joining two distal ends of a web attached thereto as recited in claim 8, wherein said means for attaching at least one of said insertion portion and said receiver portion to a web comprises adjustable means.

10. The buckle for joining two distal ends of a web attached thereto as recited in claim 9, wherein said adjustable means for attaching comprises a knurled roller and a spring-loaded keeper disposed in a central region of said body region of at least one of said insertion portion and said receiver portion of said buckle, said keeper, when utilized, being resiliently positioned against at least one of said knurled roller and said knurled bar.

11. A buckle for joining two distal ends of a web attached thereto, comprising:

a) a thin, flat insertion portion comprising a bifurcated tongue having two longitudinal legs with varying width dimension and a predetermined outer contour and projecting longitudinally away from a body region thereof and defining a longitudinal axis, said tongue comprising a central, open slot extending from a distal end thereof inwardly along said longitudinal axis toward said body region, and said open slot having a width no greater than the width of any portion of said longitudinal legs, said insertion portion, also comprising a spring-loaded keeper;

b) a receiver portion for slidably receiving and retaining said tongue therein, the outer periphery of said receiver portion and said retained insertion portion defining an outer boundary thereof, said receiver portion comprising an internal guide block key adapted and configured to interact with said open slot in a manner so as to minimize side-to-side movement of said tongue when retained in said receiver portion; and c) a pawl for releasable interaction with said long legs, a pawl having an outer contour that is a mirror shape to said outer contour of said longitudinal legs for complete engagement thereof, and having an operating portion disposed external to a housing of said receiver portion, said external portion being disposed inward of said outer boundary of said receiver portion, whereby said operating portion of said pawl is protected from impact by an object external to said buckle.

12. The buckle for joining two distal ends of a web attached thereto as recited in claim 11, said pawl for releasably locking said tongue comprises two pawls, each adapted for releasable interaction with respective ones of said protrusions.

13. The buckle for joining two distal ends of a web attached thereto as recited in claim 12, wherein each of said two pawls comprises an outer portion defining an external actuator and projecting beyond a housing of said second, receiver portion so as to be accessible for movement.

14. The buckle for joining two distal ends of a web attached thereto as recited in claim 13, wherein rotation (depression) of each of said external actuator of each of said two pawls is required to release said external protrusions of said tongue from respective ones of said pawls thereby releasing said tongue from said receiving portion.

15. The buckle for joining two distal ends of a web attached thereto as recited in claim 11, further comprising:

d) means for attaching at least one of said insertion portion and said receiver portion to a web.

16. The buckle for joining two distal ends of a web attached thereto as recited in claim 15, wherein said means for attaching at least one of said insertion portion and said receiver portion to a web comprises adjustable means.

17. The buckle for joining two distal ends of a web attached thereto as recited in claim 16, wherein said keeper is resiliently positioned against said knurled roller.

* * * * *